United States Patent [19]

Morita et al.

[11] Patent Number: 5,047,755

[45] Date of Patent: Sep. 10, 1991

[54] IMAGE INFORMATION DISPLAY APPARATUS

[75] Inventors: Toshiya Morita; Hiroshi Kamada, both of Yamatokoriyama; Sumio Kita, Nara, all of Japan

[73] Assignee: Sharp Kabushiki Kaisha, Osaka, Japan

[21] Appl. No.: 541,461

[22] Filed: Jun. 22, 1990

Related U.S. Application Data

[63] Continuation of Ser. No. 213,602, Jun. 30, 1988, abandoned.

[30] Foreign Application Priority Data

Jul. 3, 1987 [JP] Japan ..... 62-167247

[51] Int. Cl.[5] ..... G09G 5/14

[52] U.S. Cl. ..... 340/721; 340/734

[58] Field of Search ..... 340/721, 723, 724, 734; 364/518, 521; 358/22, 183

[56] References Cited

U.S. PATENT DOCUMENTS 4,642,621 2/1987 Nemoto et al. ..... 340/721
4,794,386 12/1988 Bedrij et al. ..... 340/724
4,816,812 3/1989 Iida ..... 340/721
4,890,257 12/1989 Anthias et al. ..... 340/721

FOREIGN PATENT DOCUMENTS 2180128 3/1987 United Kingdom ..... 340/721

*Primary Examiner*—Jeffery A. Brier

[57] ABSTRACT

An image information display apparatus is provided, with a plurality of address producing portions which output active signals and address signals. When the active signals and address signals are output an effective address signal is selected in response to an address deciding portion from the plurality of address signals outputted by the address producing portion in accordance with a priority order signal and the active signal inputted from outside. Accordingly read the image information is sequentially read from the address in the memory to be expressed by the effective address signal for displaying the plurality of rectangular regions. As a result the image of image parameters to display the multiwindow are reduced so that the priority order of the overlapped rectangular regions, the display positions and so on may be easily changed.

4 Claims, 9 Drawing Sheets

Fig. 2
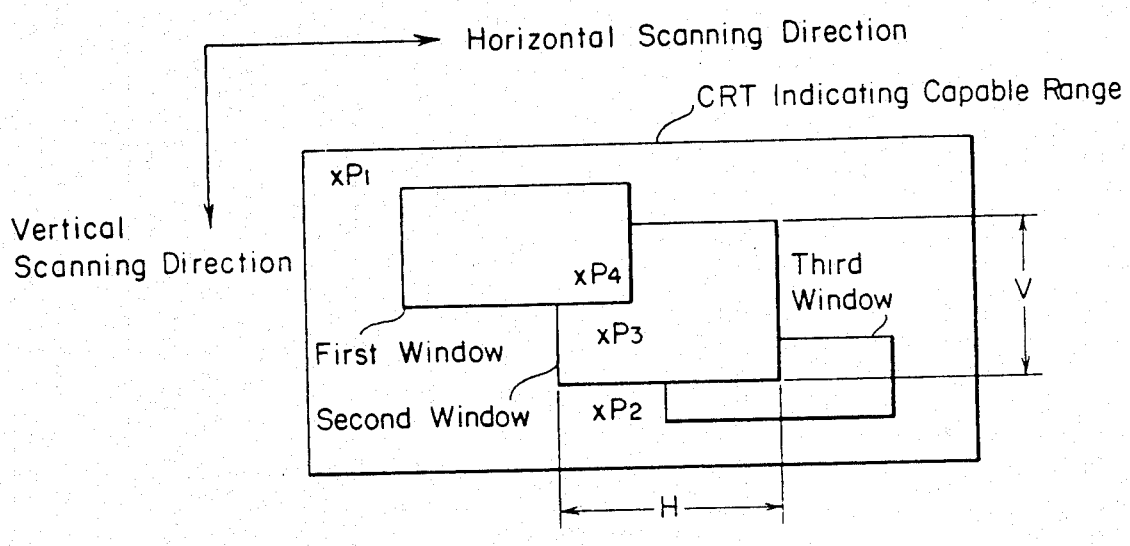
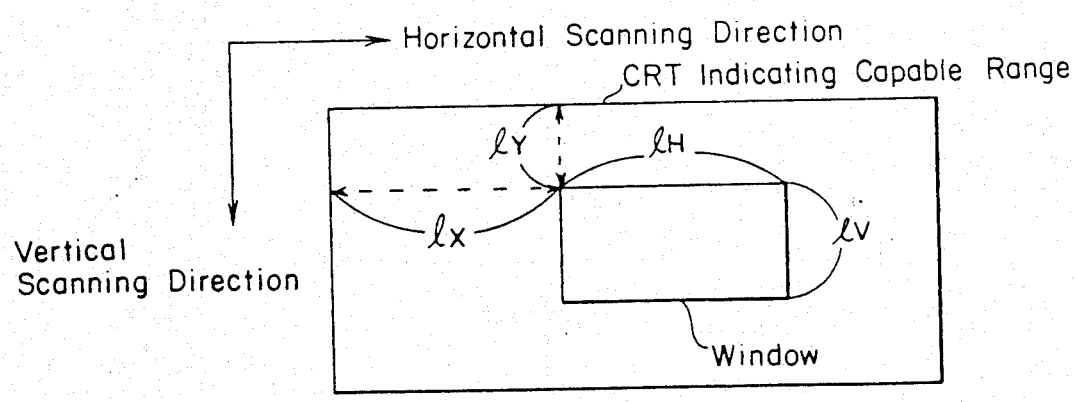
Fig. 3

IMAGE INFORMATION DISPLAY APPARATUS

This application is a continuation of application Ser. No. 213,602, filed on June 30, 1988, now abandoned.

BACKGROUND OF THE INVENTION

The present invention generally relates to an image information display apparatus and more particularly, to an image information display apparatus for use in a hardware window system which sequentially reads image information stored in a memory to provided multiwindow directly on the CRT without transferring the image information to another memory.

Generally, there are a software window system and a hardware window system are provided as a system for sequentially reading the image information from a plurality of windows stored in the memory to provide the multiwindow display on the CRT.

The software window system transfers a plurality of window image information stored in the memory to the other frame memory to compile the positioning, superpositioning or the like on the frame memory for a plurality of transferred windows. Thereafter, the image information compiled from the frame memory is sequentially read and displayed on the CRT. The hardware window system switches a pointer specifying the address of the memory during the scanning period of CRT for sequentially reading the image information of each window stored in the memory and displaying the image information directly on the CRT without transferring it to the frame memory or the like.

As all the image information for one picture face displayed on the CRT is transferred to the frame memory in advance for the case of the software window system, more time is taken to produce the window, while the degree of freedom is larger. As the address of the memory is switched by the pointer in the hardware window system to read the image information and to display it on the CRT, less time is taken to produce the window, while the degree of freedom is less.

Conventionally, an image information display apparatus for the hardware window system is as follows. In the image information display apparatus, the CRT image is split (the image may be split without limits up to the number of scanning lines) into strips corresponding to the optional scanning lines in the vertical direction as shown in FIG. 10. Furthermore, each of the respective strips is split (the maximum number of splits is 16) into "tile" having an optional bit width in the horizontal direction. Accordingly, a first window 51 is composed of a tile 52 of the (strip 2-tile 2) and a tile 53 of the (strip 3-tile 2). Namely, a plurality of tiles are combined to optionally change the shape of the window or to express a plurality of superposed windows. As shown in FIG. 11, the window-descriptor provided on the memory is composed of one or more strip-descriptors in the display order. The respective strip descriptors have a header and one or more tile-descriptors continuously linked in the order of the display. The header has a 00 number of scanning lines of the strip, the pointer for the strip-descriptor to be displayed next and the number of the tile-descriptors to be included in the strip. Also, the tile-descriptors have the width of the tile, the start-address in the memory, the number of bits per picture element, and so on.

An internal display-processor reads the contents of the descriptor-pointer-register 55 for every one frame to read the strip-descriptor linked in order from the first strip-descriptor of the window-descriptor to be shown by this pointer in order to display the image. For example, the strip-descriptor 56 is read into the horizontal fly-back line before moving to the display of the strip set in the inner register. A bit map data 58 specified by, for example, the tile-descriptor 57 in the strip-descriptor 56 is transferred and displayed onto the CRT and is displayed. After completion of the display of the strip-descriptor 56 in this manner, the following strip-descriptor 60 is read again into the horizontal fly-back line time in accordance with the pointer in the header 59 so as to repeat a similar operation.

However, an image information display apparatus of the conventional hardware window system has the CRT picture face split into a plurality of strips and tiles. The apparatus has the strip-descriptors and the tile-descriptors with image parameters of each strip and each tile being accommodated therein, so that the strip-descriptors composed of a plurality of tile-descriptor strings are sequentially read during the horizontal fly-back line time for every one frame in order to display them on the CRT. As a result, more time is required for the window display. Also, when a priority order for superposed windows, display positions or the like is changed, the image parameters are large and difficult to change.

SUMMARY OF THE INVENTION

Accordingly, an object of the present invention is to provide an image information display apparatus which has only image parameters such as the width, size, position, start address, and so on of the window for each window without splitting the window into strips and tiles. Therefore, the image parameters are stored into the inner register, so that the image parameters of the window are not necessary to be read during the horizontal fly-back line time and multiwindows may be displayed at a high speed. Accordingly, the respective windows may be easily superposed on each other and the display positions may be easily varied.

In accomplishing the above-described object, according to one preferred embodiment of the present invention, there is provided an image information display apparatus which has a memory for storing the image information. The image information stored in the memory is sequentially read and displayed on the CRT, which is characterized in that there are provided plurality of address producing portions corresponding to a plurality of rectangular regions established on the images to be displayed on the CRT. The apparatus outputs active signals showing whether or not the scanning position of the CRT is located within the rectangular region, outputs address signals expressing the addresses of the memory for the image information of the rectangular regions being accommodated therein. An address deciding portion decides effective address signals from a plurality of address signals outputted from the plurality of address producing portions in accordance with the priority order signals inputted from outside and the active signals outputted from the address production portion. The image information is sequentially read from the addresses of the memory to be expressed with effective address signals determined by the above-described address deciding portion in order to display a plurality of rectangular regions on the CRT.

When the address signals representing the address of the rectangular region corresponding to the address producing portion and an active signal representing whether or not the scanning position of the CRT is within the rectangular regions are outputted from the plurality of address producing portions, one effective-address-signal from the plurality of address signals outputted from the plurality of address producing portions is developed by the address deciding portion. Accordingly, the image information is read from the address of the memory represented with the effective address signal in order to sequentially display a plurality of rectangular regions on the CRT.

BRIEF DESCRIPTION OF THE DRAWINGS

These and other objects and features of the present invention will become clear from the following description taken in conjunction with the preferred embodiments thereof with reference to the accompanying drawings, in which:

FIG. 2 is a view for a display example of a multi-window;

FIG. 3 is a view for illustrating a region specification parameter of a window;

DETAILED DESCRIPTION OF THE INVENTION

Figure 1:
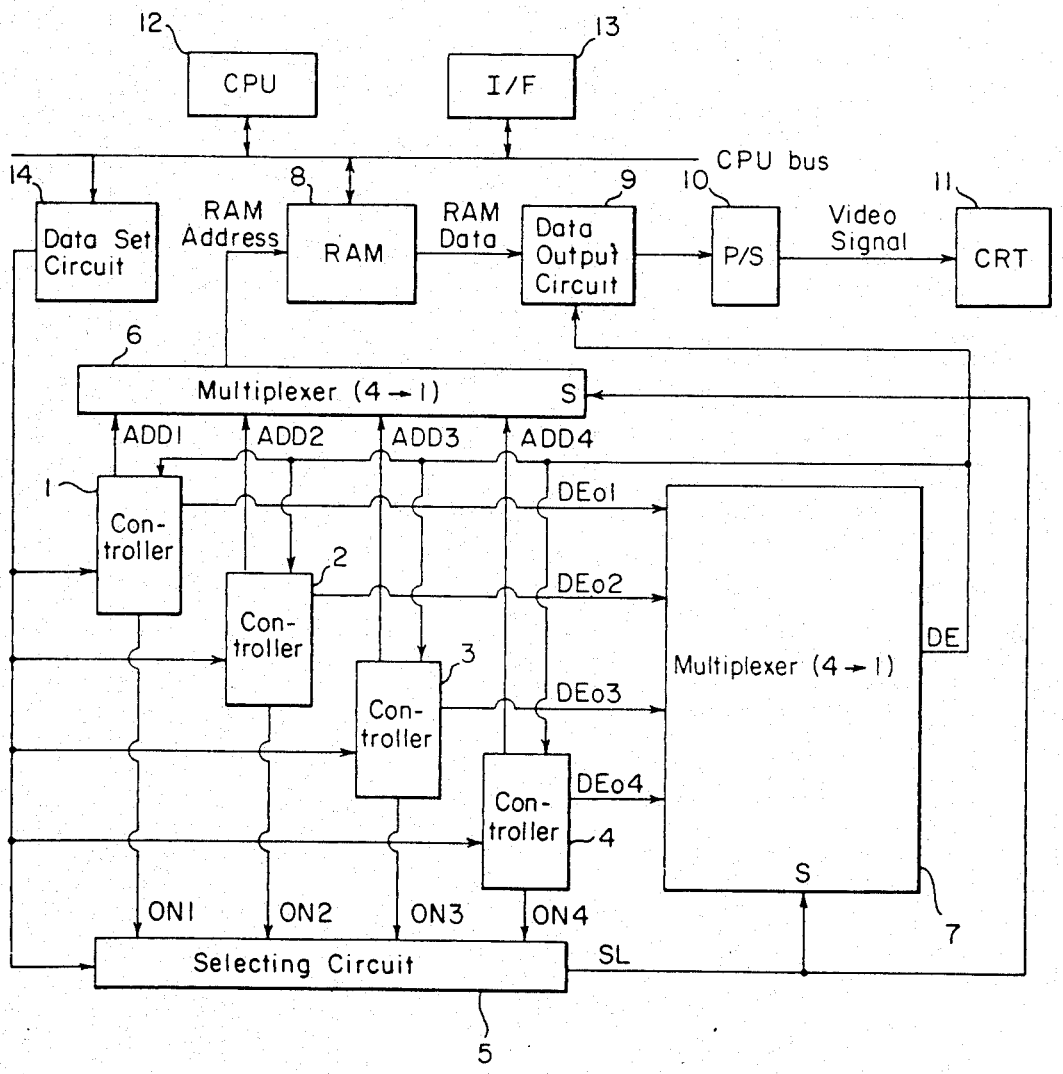
FIG. 1 is a block diagram for one embodiment of an image information display apparatus of the present invention.

Before the description of the present invention proceeds, it is to be noted that like parts are designated by like reference numerals throughout the accompanying drawings.

Referring now to the drawings, there is shown in FIG. 1, an image information display apparatus capable of effecting the displaying operation according to one preferred embodiment of the present invention for displaying three windows in addition to a background picture face. Controller 1 through controller 4, which are address producing portions, respectively correspond to the background picture face of FIG. 2 and the first window through the third window, having an address producing circuit (not shown), a window region judging circuit and so on. The address producing circuit outputs address signals ADD1 through ADD4 respectively showing the addresses of a RAM (random access memory) 8 with the corresponding background picture face or the image information of the window being accommodated therein. Also, the window region judging circuit outputs active signals ON1 through ON4 showing whether or not the scanning position of the CRT 11 is within the corresponding window.

A selection circuit 5 outputs a selection signal SL for selecting an effective address signal from address signals ADD1 through ADD4 of the controller 1 through controller 4 by active signals ON1 through ON4 outputted from controller 1 through controller 4 and a priority order signal showing a priority order of the controller 1 through controller 4 output by the data set circuit 14. The multiplexer 6 selects an effective RAM address signal in response to the scanning position of the present CRT 11 from address signals ADD1 through ADD4 in accordance with the selection signal SL outputted from the selection circuit 5. The address deciding portion is composed of the selection circuit 5 and the multiplexer 6.

Effective-portion signals DE01 through DE04 outputted from the controller 1 through controller 4 show the effective-portion in the image data stored in the RAM 8 corresponding to the respective address signals ADD1 through ADD4. The multiplexer 7 selects a RAM data effective-portion signal DE for deciding the effective-portion of the image data (hereinafter referred to as RAM data) outputted from the RAM 8 in accordance with the RAM address from the effective-portion signals DE01 through DE04 in accordance with the address selection signal SL outputted from the selection circuit 5.

The RAM 8 is a 2-port RAM which outputs or stores (the storing operation is effected by the address from a CPU bus) the image data by time sharing with respect to the RAM address given from the multiplexer 6 and the address given from the CPU bus. The data output circuit 9 delivers to a parallel/serial conversion circuit 10 only the effective portion shown by the RAM data effective-portion signal DE, which is outputted from the multiplexer, among the RAM data outputted from the RAM 8. The parallel/serial conversion circuit 10 converts in parallel/serial relation the effective portion of the RAM data to be outputted from the data output circuit 9 for delivering the video signals to the CRT 11.

Figure 4:
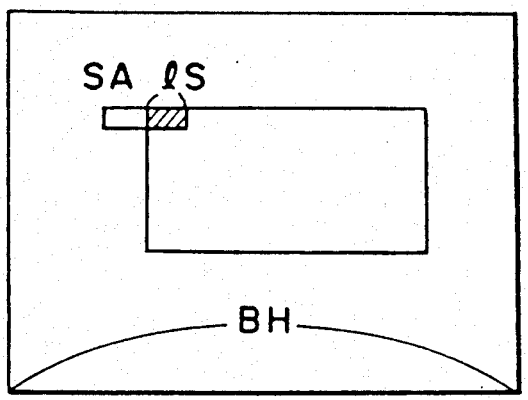
FIG. 4 is a view showing a window region of FIG. 3 on the window map.

The CPU 12 controls all the image information display apparatus while an interface circuit 13 inputs and outputs the image information. Also, a data set circuit 14 outputs the data on the window address for the window region with respect to controller 1 through the controller 4. During the vertical scanning period of the CRT, a priority order signal is output representing the priority order of controller 1 through controller 4 with respect to the selection circuit 5. Namely, as shown in FIG. 3, signals corresponding to parameters lX, lY, lV and lH for specifying the corresponding one window region on the CRT picture face from the data set circuit 14 are input to controller 1 through controller 4 in addition to the start address SA and the bit map width BH. FIG. 4 shows the window region, defined in FIG. 3, on the memory map.

Controller 1 through controller 4 each turn the active signal ON into "1" when the scanning position of CRT 11 is in the window region shown with parameters lX, lY, lV and lH in order to output an address signal ADD and an effective-portion signal DE0. The selection circuit 5 outputs a selection signal SL in accordance with active signals ON1 through ON4 outputted from controller 1 through the controller 4 respectively and a priority order signal to be instructed from the data set circuit 14. The multiplexer 6 selects an effective address signal with respect to the scanning position of the present CRT from among the address signals ADD1 through ADD4 outputted from controller 1 through controller 4 in accordance with the selection signal SL outputted from the selection circuit 5 and outputs the signal to the RAM 8 as the RAM address. On the other hand, the multiplexer 7 selects the effective-portion signal DE0 from the controller which outputs the RAM address signal from the effective-portion signals DE01 through DE04 outputted from controller 1 through controller 4 in accordance with the selection signal SL outputted from the selection circuit 5 so as to output the signal to the data output circuit 9 as the RAM data effective-portion signal DE.

In accordance with the RAM data effective-portion signal DE inputted from the multiplexer 7, the data output circuit 9 selects only the effective portion from among the RAM data outputted from RAM 8 to output the data into the parallel/serial conversion circuit 10 in accordance with the scanning timing of the CRT 11 in order to convert the data in a parallel/serial relation. The video signals provided in this manner are outputted to the CRT 11 in order to display the image of the multiwindow.

Figure 5:
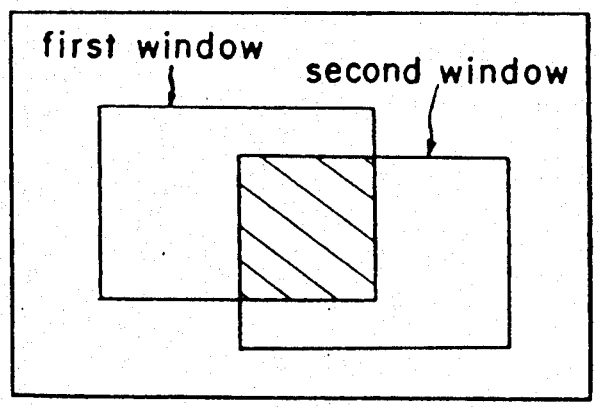
FIG. 5 is a view showing how the windows are overlapped.

Accordingly, when the windows have been overlapped as in FIG. 5, the upper and lower portions of the superposed oblique-line regions may be changed with the first window and the second window being specified by the priority order signal from the data set circuit 14 replaced in priority order. Also, in the case of the scroll where one window moves vertically and laterally in the CRT picture, all that is necessary is the parameters X and Y to be rewritten. Also, in the case of paning the window interior, all that is necessary is for only the start address SA of one window to be rewritten, which makes it possible to control the window with extreme ease and high speed.

Figure 6:
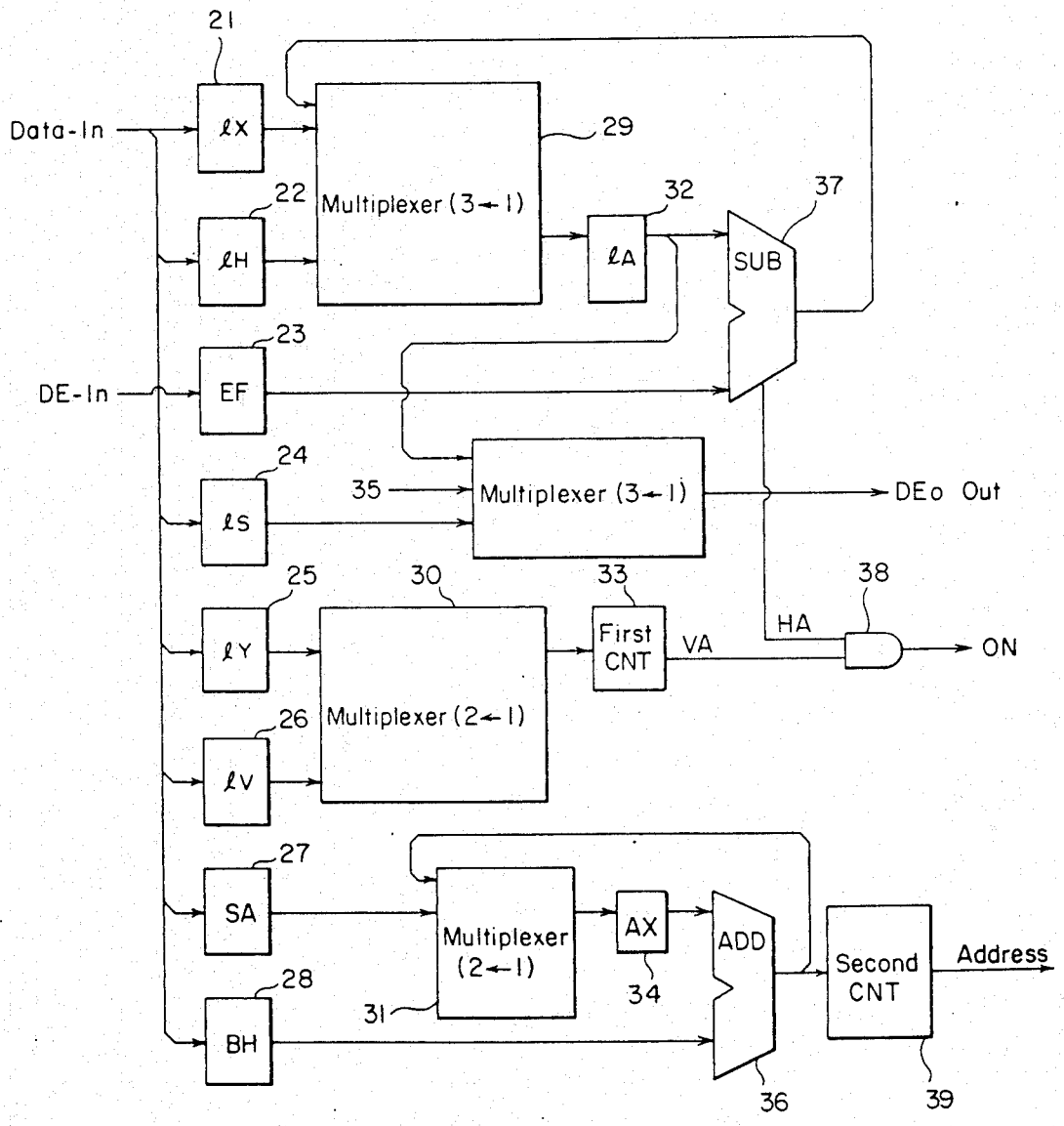
FIG. 6 is a block diagram of a controller in FIG. 1.

The controller will be described hereinafter. FIG. 6 shows a block diagram of a controller. The registers 21, 22, 25, 26, 27 and 28 respectively accommodate the parameters lX, lH, lY and lV inputted from the data set circuit 14, the start address SA, and the bit map width BH. The lS register 24 accommodates (see FIG. 4) a parameter lS shows the effective data from the image data of the start address SA and outputs the data for the first time at the horizontal scanning. The EF register 23 stores a RAM data effective-portion signal DE specified in the previous calculation.

The lA register 32 is a register used when the region calculation in the horizontal scanning direction is effected. The first counter 33 is a down counter used when the region calculation in the vertical scanning direction is effected. Also, the AX register 34 is a register used when the address production is calculated. The second counter 39 takes in and counts the output signal from the adder 36 in order to output the address signal ADD.

The multiplexers 29, 30 and 31 respectively select the data outputted to the lA register 32, the first counter 33 and the AX register 34. The multiplexer 35 is used when the effective-portion DE0 is outputted. The AND gate 38 outputs an active signal in response to the "and" operation of the signal HA outputted from the subtractor 37 and a signal VA outputted from the first counter 33.

The horizontal scanning direction region-recognition operation, the vertical scanning direction region-recognition operation of the controller and the address calculation operation of the RAM 8 in the window region will be described hereinafter.

Figure 7:
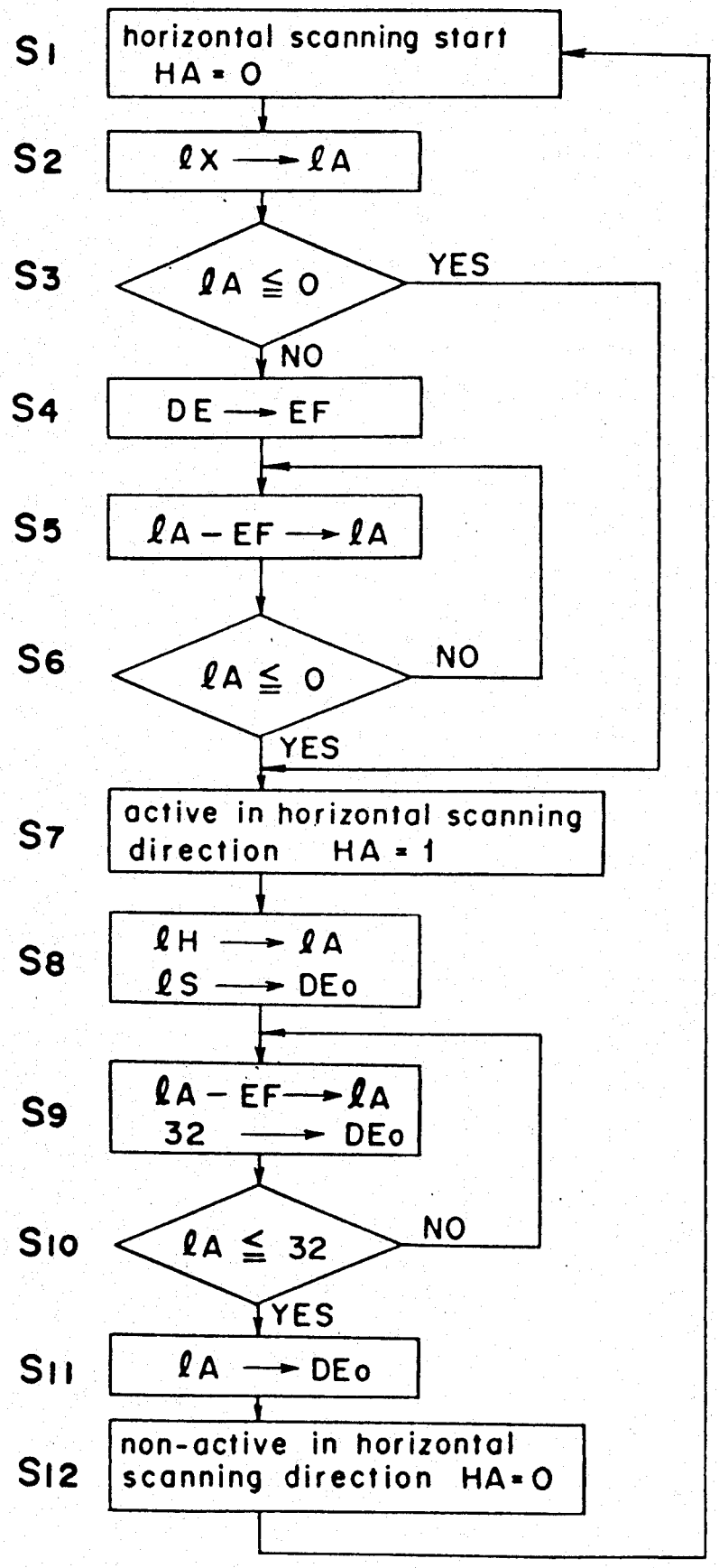
FIG. 7 is a flow chart of the horizontal scanning direction region-recognition operation of a window.

FIG. 7 is a flow chart of the horizontal scanning direction region-recognition operation of the window. The horizontal scanning direction region-recognition operation will be described fully with reference to the flow chart.

When the horizontal scanning starts at step S1, a signal HA showing whether or not the present controller is active in the horizontal scanning direction is made "0" in order to indicate that the controller is not active in the horizontal scanning direction.

At step S2, a parameter X, which is stored in the lX register 21, is selected by the multiplexer 29 and is stored in the lA register 32.

At step S3, it is judged whether or not the content of the lA register 32 is less than or equal to 0. When the content is less than or equal to 0, the process advances to step S7. When the contents is greater than 0, the step advances to process S4.

At step S4, the RAM data effective-portion signal DE outputted from the multiplexer 7 of FIG. 1 at the previous calculation is input and stored in the EF register 23.

At step S5, the content of the EF register 23 is subtracted from the content of the lA register 32 by a subtractor 37 so that the results thereof are stored into the lA register 32 again.

At step S6, it is judged whether or not the content of the lA register 32 is less than or equal to 0. When the content is less than or equal to 0, the process advances to step S7. When the content is greater than 0, less the process returns to step S5.

When the content of the lA register 32 is less than or equal to 0 at step S7, the signal HA is made "1." The scanning position of the CRT is within the horizontal scanning direction region of the window in order to indicate that the present controller is active in the horizontal scanning direction.

At step S8, the parameter lH accommodated in the lH register 22 is stored in the lA register 32. The effective portion in the data outputted at first is a value to be shown with the parameter lS (see FIG. 4), so that the parameter lS stored in the lS register 24 is outputted as an effective-portion signal DE0.

At step S9, the content of the EF register 23 is subtracted from the content of the lA register 32 by the subtractor 32 so that the results are stored into the lA register 32. The parameter lS outputted as the effective-portion signal DE0 at step S8 is selected as the RAM data effective-portion signal DE by the multiplexer 7. The parameter 5 is inputted again into the present controller and stored in the EF register 23, because the present controller is active at the step S7.

Accordingly, the above-described subtraction becomes "lH−lS". Furthermore, B2, which represents the data length of one image data, is outputted as the next effective-portion signal DE0.

At step S10, it is judged whether or not the content of the lA register 32 is less than or equal to 32. When the content is less than or equal to 32, the process advances to step S11. When the content is greater than 32, the process returns to step S9. Namely, when the effective length of the next image data is subtracted from the length of the unscanned portion in the horizontal scanning direction of the window, so that the result of the image data length becomes less than or equal to 32, it follows that the next CRT scanning position is outside the window region.

At step S11, when the result at the step S10 is less than or equal to 32, the content of the A register 32 is outputted as the effective-portion signal DE0.

At step S12, as the scanning position of the next CRT is outside the scanning direction region of the window. The signal HA becomes "0" and the present controller is not active in the horizontal scanning direction so that the step returns to step S1.

Figure 8:
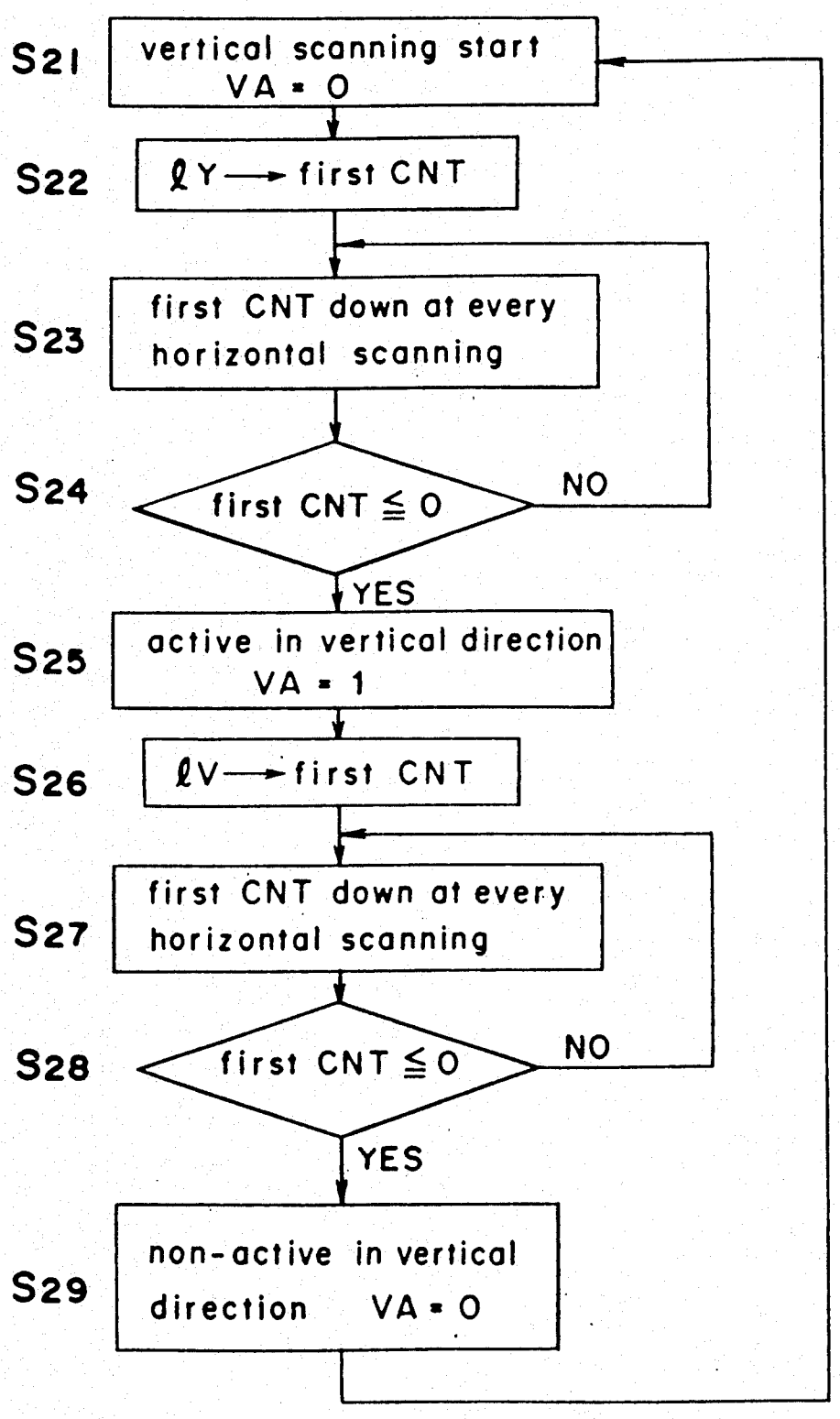
FIG. 8 is a flow chart of the vertical scanning direction region-recognition operation of a window.

FIG. 8 is a flow chart of the vertical scanning direction region-recognition operation of the window. The vertical scanning direction region-recognition operation will be described in detail in accordance with the flow chart.

At step S21, when the vertical scanning is started, a signal VA, which shows whether or not the present controller is active in the vertical scanning direction, becomes "0" in order to indicate that the controller is not active in the vertical scanning direction.

At step S22, the parameter lY, which is stored in the lY register 25, is stored in the first counter 33.

At step S23, the first counter 33, which is a down counter for each horizontal scanning of the CRT, is counted down.

At step S24, it is judged whether or not the content of the first counter 33 is less than or equal to 0. If the content is or less than or equal to 0, the process moves to step S25. If the content is greater than 0, the process returns to step S23.

When the content of the first counter 33 is less than or equal to 0 at step S25, the scanning position of the CRT is within the vertical direction region of the window. Thereby, the present controller is active in the vertical scanning direction with the signal VA being "1".

At step S26, the parameter lV, which is stored in the lV register 26, is stored in the first counter 33.

At step S27, the first counter 33 is counted down for each horizontal scanning of the CRT.

At step S28, it is judged whether or not the content is less than or equal to 0, the process advances to step S29. If the content is greater than 0, the process returns to step S27.

At step S29, when the content of the first counter 33 is less than or equal to 0, the scanning position of the CRT is outside the vertical-scanning direction region of the window, and the signal VA is "0" for in dicating that the present controller is not active in the vertical scanning direction. Thereafter, the process returns to step S21.

Assume that the present controller is a controller 3 of FIG. 1 corresponding to a second window of FIG. 2. As the scanning position P1 is not located in either the horizontal scanning direction region H of the second window or the vertical scanning direction region V thereof when the scanning position of the CRT is at P1 of FIG. 2, both the signal HA outputted by the flow chart of FIG. 7 and the signal VA outputted by the flow chart of FIG. 8 become "0", and the active signal ON3 outputted from the AND gate of FIG. 6 becomes "0". Accordingly, the address signal ADD3 outputted at this time is not selected by the multiplexer 6. When the position P2 is within the horizontal scanning direction region H of the second window, but is not within the vertical scanning direction region V, the signal HA becomes "1", the signal VA becomes "0", and the active signal ON3 outputted from the AND gate 38 becomes "0". Accordingly, the address signal ADD3 is not selected as in the position for P1.

When the scanning position of the CRT is in the position P3, P3 is in the horizontal scanning direction region H and the vertical scanning direction region V, so that both the signal HA and the signal VA become "1", and the active signal ON3 becomes "1". As described later, the address signal ADD3 outputted from the controller 3 is a selection signal SL in accordance with the active signal ON3 which has become "1", and the address signal is selected as a RAM address signal by the multiplexer 6. As the P4 is within the horizontal scanning direction region H and the vertical scanning direction region V when the scanning position of the CRT is at P4, the active signal ON3 becomes "1" as in position for P3. Simultaneously, when the scanning position P4 is within the horizontal and vertical both-direction region, the active signal ON2 outputted from the controller 2 also becomes "1". In this case, a priority order signal, which shows a higher priority order of the controller 2, is outputted into the selection circuit 5 from the data set circuit 14 of FIG. 1. The multiplexer 6 selects an address signal ADD2 to be outputted from the controller 2 instead of an address signal ADD3 in response to the priority order signal and a selection signal SL in accordance with the active signals ON2, ON3 which are "1". As a result, the image of the first window is displayed on the scanning position P4.

Figure 9:
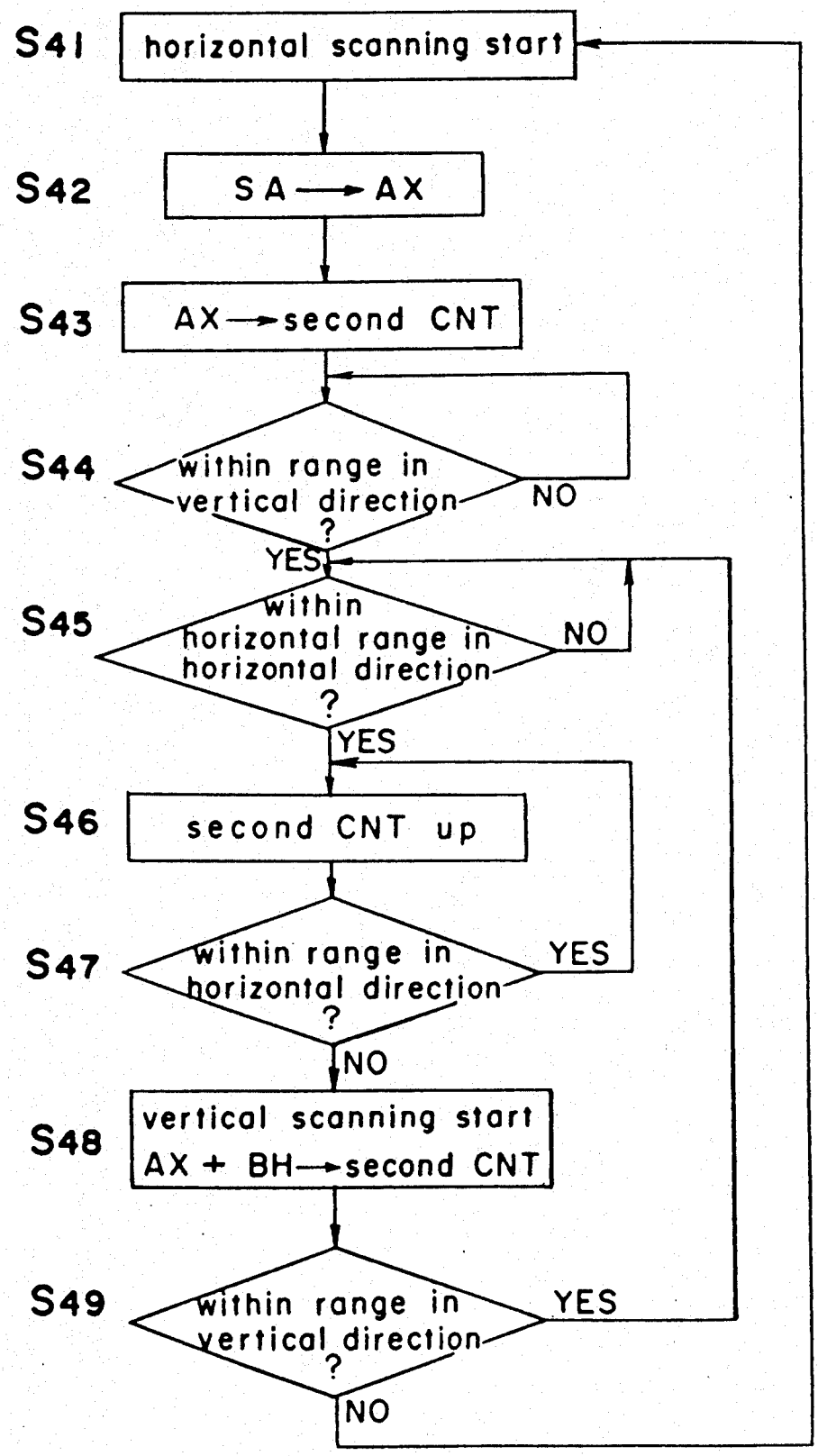
FIG. 9 is a flow chart of an address signal output.
Figure 10:
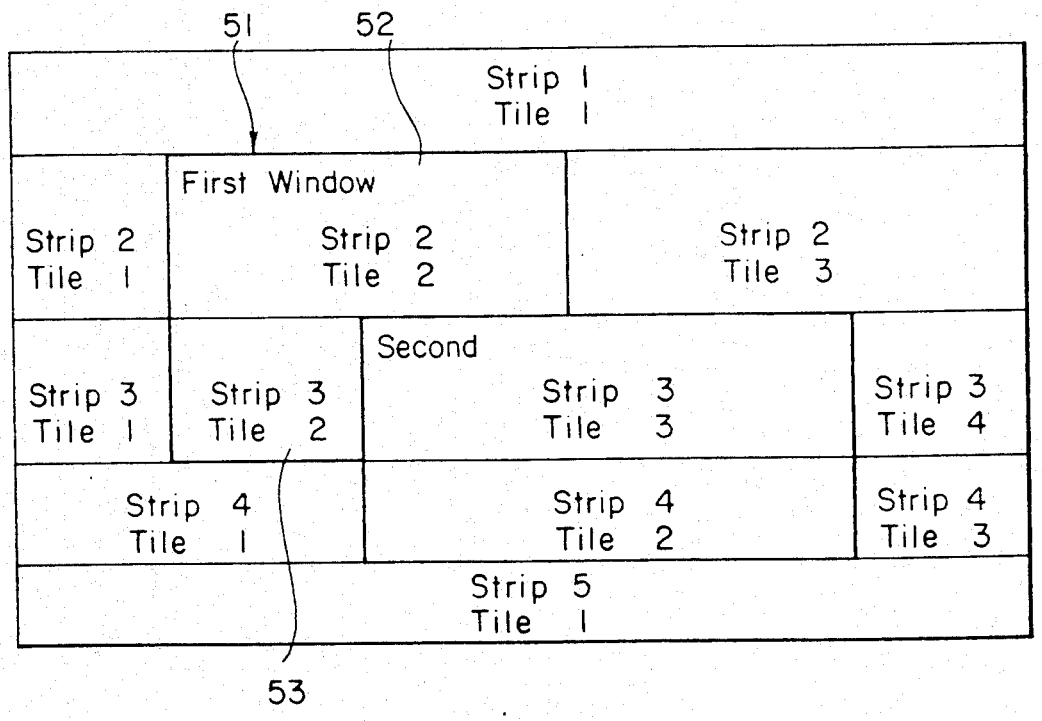
Fig. 10 PRIOR ART
FIG. 10 is a view which illustrates the strips and the tiles in the conventional hardware window system.
Figure 11:
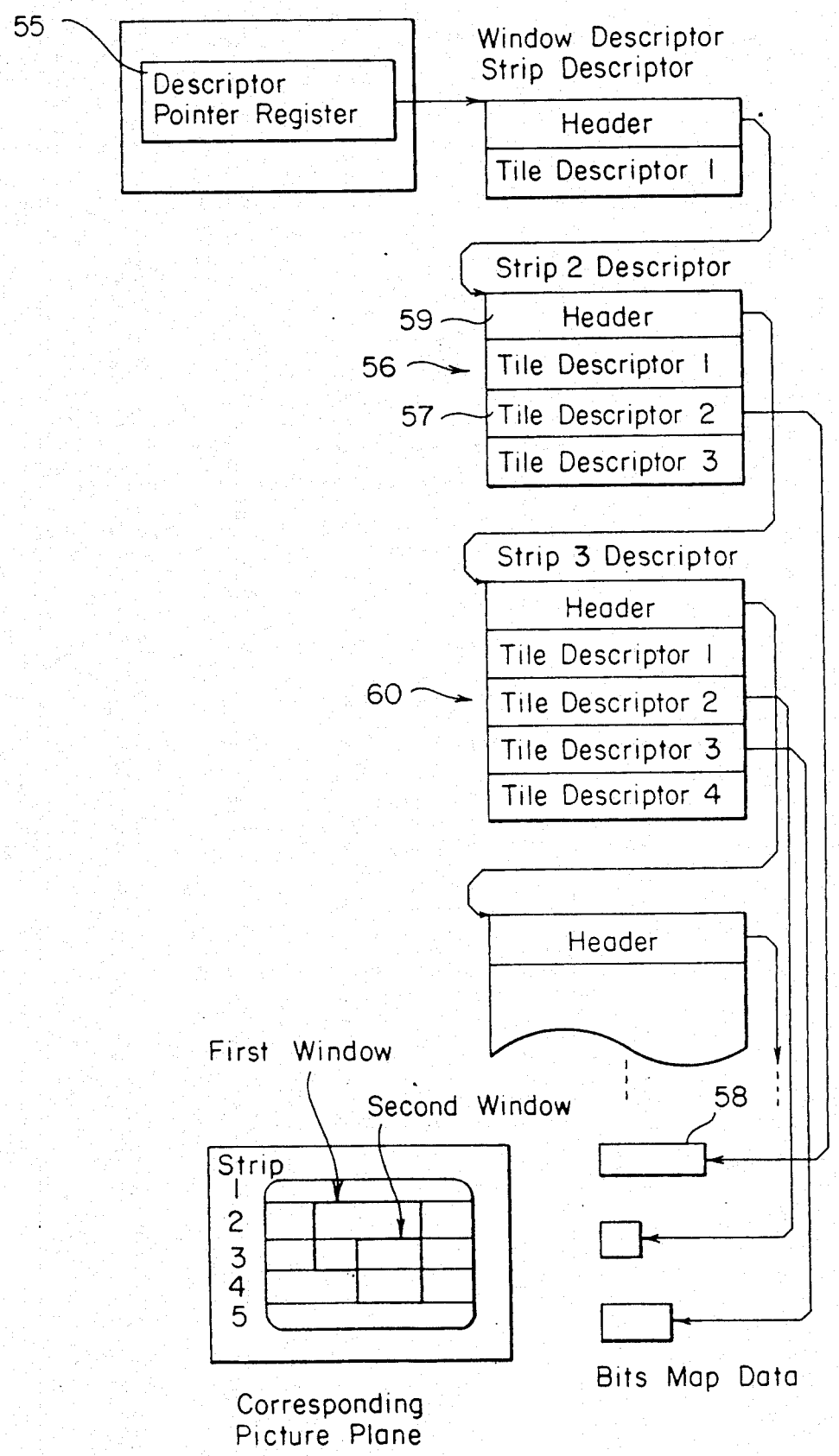
Fig. 11 PRIOR ART
FIG. 11 is a view for illustrating the picture face corresponding to the construction example of a window-descriptor in FIG. 10.

FIG. 9 is a flow chart of the address signal output. An operation which outputs the address signal ADD will be described in detail from the controller in accordance with the flow chart.

At step S41, the horizontal scanning operation of the CRT starts.

At step S42, the start address SA, which is stored in the SA register 27, is stored in the AX register 34.

At step S43, the content (namely, the start address SA) of the AX register 34 is stored in the second counter 39.

At step S44, it is judged whether or not the scanning position of the CRT is within the vertical scanning direction region of the window corresponding to the present controller. If the scanning position is within the region (namely, the signal VA is "1" in the flow chart of FIG. 8), the process advances to step S45. If the scanning position is not within the region (namely, the signal VA is "0"), the process waits until the scanning position enters the region.

At step S45, it is judged whether or not the scanning position of the CRT is within the horizontal scanning direction region of the window corresponding to the present controller. If the scanning position is within the region (namely, the signal HA is "1" in the flow chart of FIG. 7), the process advances to step S46. If the scanning position is not within the region (namely, the signal HA is "0"), the process waits until the scanning position enters the region. So far, the start address SA is outputted as the address signal ADD from the second counter 39, but the address signal ADD is not selected by the multiplexer 6 of FIG. 1 because the present controller is not active.

At step S46, if the CRT scanning position is within the vertical and horizontal scanning direction region (namely, the active signal ON is "1") of the window, the second counter 39 is counted up only at one time to output the contents as the address signal ADD. During this period, the address advances by one data length portion in the right direction of the drawing from the start address SA in the memory map (see FIG. 4) of the window corresponding to the present controller.

At step S47, it is judged whether or not the scanning position of the CRT is within the horizontal scanning direction region of the window. If the scanning position is still within the region, the process returns to step S46 to count up the second counter 39. If the scanning position is not within the region, the process advances to step S48.

At step S48, when the address sequentially advances of the right direction in the drawing on the memory map of FIG. 4 until the scanning position of the CRT goes out of the horizontal scanning direction region of the window, the vertical scanning start adds the content (namely, the start address SA) of the AX register 34 to the bit map width BH stored in the BH register 38 by the adder 36. Thereby the start address (the address under and adjacent to the start address SA in FIG. 4) of the next horizontal scanning is calculated, so that the address is stored in the second counter 31 and outputted as the address signal ADD.

At step S49, it is judged whether or not the scanning position of the CRT stays within the vertical scanning direction region of the window. If the scanning position stays within the region, the process returns to step S45. If the scanning position stays in the horizontal scanning direction region of the window at step S45, the address is outputted with the second counter 39 being counted up at step S46 again during the next horizontal scanning operation of the CRT. If the scanning position is not within the region, the entire display of the window corresponding to the present controller is completed and the process returns to step S41.

Assume that, for example, the present controller is a controller 3 of FIG. 1 corresponding to the second window of FIG. 2. When the scanning position of the CRT stays within the horizontal and vertical scanning direction regions H and V of the second window, the controller 3 calculates the address of the right direction in the drawing sequentially from the start address SA on the memory map of FIG. 4 in order to output the address signal ADD3. When the CRT scanning position goes out of the horizontal scanning direction region H of the second window, the controller 3 automatically calculates the start address at the next horizontal scanning time in order to set the address in the second counter 39 so as to wait for the scanning position in the next horizontal scanning of the CRT to go again into the horizontal scanning direction region H of the second window. When the CRT scanning position goes into the horizontal scanning region H of the second window again, the controller 3 sequentially calculates the address from the start address at the next horizontal scanning time to output the address signal ADD3.

Namely, in the image information display apparatus, the active signal ON of "1" is outputted by the algorithm of FIGS. 7 and 8 from one or more controllers corresponding to the background or the window with the scanning position of the CRT 11 existing therein at present, and the address signal ADD showing the address of the image data is outputted by the algorithm of FIG. 9. Thus, only the address signal ADD outputted from only one controller which has outputted the active signal ON of "1" in response to the data set circuit 14. with a high priority order is selected. The image data are read from the address of RAM 8 in order to be expressed by the address signal ADD (namely, the RAM address). Only the effective portion shown by the RAM data effective signal DE among the image data is outputted from the data output circuit 9 and displayed on the CRT. The above-described operation is repeated as the scanning position of the CRT moves to display the multi-window.

According to the image information display apparatus, the windows are not necessary to be split into strips and tiles. Thereby, the picture parameters may be made fewer (having seven parameters per window), and the overlapping priority order of the respective windows, the display position and so on may be easily changed. Furthermore, the image parameters are not required to be read during the horizontal fly-back line period and the multiwindow may be displayed at a high speed.

As is clear from the foregoing description, according to the arrangement of the present invention, the image information display apparatus of the present invention is provided with a plurality of address prducing portions corresponding to a plurality of rectangular regions set on the image to be displayed on the CRT, and an address deciding portion for deciding an effective address. When the plurality of address producing portions output active signals and address signals, an effective address signal is selected in response to the address deciding portion from the plurality of address signals outputted from the address producing portions in accordance with one priority order signal and the active signal inputted from outside in order to sequentially read the image information from the address of the memory to be expressed by the effective address signal for displaying the plurality of rectangular regions. Therefore, the image parameters for displaying the multiwindow are fewer so that the priority order of the overlapped rectangular region, the display position and so on are easily changed. Also, the image parameters are not required to be read during the horizontal fly-back line time, so that the multiwindow may be displayed at a high speed.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An image information display apparatus for displaying image information on a CRT having a plurality of rectangular display regions comprising:

central processing means for inputting and outputting the image information and controlling the apparatus;

a memory for storing and outputting the image information under control of said central processing means;

a plurality of address producing means corresponding in number to the plurality of rectangular display regions for developing active signals indicating whether or not the scanning position of the CRT is within one of the plurality of rectangular display regions and address signals addressing the memory for the image information at the one rectangular region determined to have the scanning position of the CRT therein, each of said plurality of address producing means including, a first register for storing a first parameter indicative of a horizontal coordinate position on the CRT for one of the plurality of rectangular display regions, a second register for storing a second parameter indicative of a vertical coordinate position of the CRT for said one rectangular display region, a third register for storing a third parameter indicative of the horizontal width of said one rectangular display region, and a fourth register for storing a fourth parameter indicative of the vertical width of said one rectangular display region;

data set means for developing a priority signal for said plurality of address producing means in response to an input from said central processing means; and address deciding means for selecting an effective address signal from among said plurality of address producing means in response to said priority order signal and the active signals outputted from said address producing means, so that the image information is sequentially read from the memory corresponding to said effective address signal from the address deciding means for displaying the plurality of rectangular display regions on the CRT.

2. An apparatus for displaying image information on display means having a plurality of display windows comprising:

central processing means for inputting and outputting the image information and controlling the apparatus;

a memory for storing and outputting the image information under control of said central processing means;

a plurality of address producing means corresponding in number to the plurality of display windows for developing address signals which address said memory, effective portion signals which indicate an effective portion of the image information and active signals which indicate whether or not the scanning position of the display means is within one of said plurality of display windows from each of said plurality of address producing means, each of said plurality of address producing means including, a first register for storing a first parameter indicative of a horizontal coordinate portion on the display means for one of the plurality of display windows, a second register for storing a second parameter indicative of a vertical coordinate position for said one display window, a third register for storing a third parameter indicative of the horizontal width of said one display window, and a fourth register for storing a fourth parameter indicative of the vertical height of said one display window;

data set means for developing priority order signals for said plurality of address producing means in response to an input from said central processing means;

address deciding means for selecting an effective memory address signal and a memory data effective portion signal from said address signals and said effective portion signals in response to said active signals and said priority order signals respectively;

said effective memory address signal being input to said memory for outputting a RAM data signal therefrom for the image information corresponding to said effective memory address signal; and data output means for outputting said effective portion of said RAM data signal in response to said memory data effective portion signal;

said effective portion of said RAM data signal being input to the display means for displaying the image information in the plurality of display windows.

3. An apparatus according to claim 2, wherein said address deciding means comprises:

a selecting circuit for developing a selection signal in response to said active signals and said priority order signal;

a first multiplexer for developing said effective memory address signal in response to said address signals and said selection signal; and a second multiplexer for developing said memory data effective portion signal in response to said effective portion signal and said selection signal.

4. A method for displaying image information on display means having a plurality of display windows, comprising the steps of:

storing the image information in a memory;

developing a plurality of address signals which address said memory, effective portion signals which indicate an effective portion of the image information and active signals which indicate whether or not the scanning position of the display means is within one of said plurality of display windows corresponding to each of the plurality of display windows;

storing a first parameter indicative of a horizontal coordinate position on the display means for each of said plurality of display windows;

storing a second parameter indicative of a vertical coordinate position on the display means for each of said plurality of display windows;

storing a third parameter indicative of the horizontal width for each of said plurality of display windows;

storing a fourth parameter indicative of the vertical width for each of said plurality of display windows;

selecting a priority order signal in response to an input from central processing means;

determining one of the plurality of display windows having the scanning position of the display means contained therein;

developing an effective memory address signal from said plurality of address signals in response to said plurality of active signals and said priority order signal;

selecting a memory data effective portion signal in response to said plurality of active signals and said priority order signal;

outputting a data signal from said memory for the image information corresponding to said effective memory address signal;

developing said effective portion of said data signal in response to said memory data effective portion signal; and displaying said effective portion of said data signal on the display means for one of the plurality of display windows.

* * * * *